US005735774A

United States Patent [19]

Maresh

[11] Patent Number: 5,735,774

[45] Date of Patent: Apr. 7, 1998

[54] ACTIVE CRANK AXIS CYCLE MECHANISM

[76] Inventor: Joseph Douglas Maresh, P.O. Box 645, West Linn, Oreg. 97068-0645

[21] Appl. No.: 503,931

[22] Filed: Jul. 19, 1995

[51] Int. Cl.[6] ..... A63B 22/00; A63B 23/10

[52] U.S. Cl. ..... 482/57; 482/52

[58] Field of Search ..... 482/51, 52, 53, 482/57, 58–65, 70–72, 908

[56] References Cited

U.S. PATENT DOCUMENTS

| | | | |
|---|---|---|---|
| 4,477,072 | 10/1984 | De Cloux | 482/57 |
| 5,161,430 | 11/1992 | Febey | 74/594.7 |
| 5,267,922 | 12/1993 | Robinson | 482/52 |
| 5,279,529 | 1/1994 | Eschenbach | 482/52 |
| 5,290,211 | 3/1994 | Stearns | 482/70 |
| 5,299,992 | 4/1994 | Wilkinson | 482/52 |
| 5,299,993 | 4/1994 | Habing | 482/52 |
| 5,397,286 | 3/1995 | Chang | 482/62 |
| 5,433,680 | 7/1995 | Knudsen | 482/57 |
| 5,445,583 | 8/1995 | Habing | 482/57 |
| 5,453,066 | 9/1995 | Richter | 482/57 |
| 5,496,238 | 3/1996 | Taylor | 482/57 |
| 5,499,956 | 3/1996 | Habing et al. | 482/52 |
| 5,518,473 | 5/1996 | Miller | 482/52 |

*Primary Examiner*—Stephen R. Crow

[57] ABSTRACT

A cycling mechanism consisting of foot pedals attached to rotatable cranks, in which the crank axes are independently connected to the machine frame in a movable manner such that in addition to each of cranks being rotatable about their respective axis, the crank axes are simultaneously allowed to translate to thereby cause the attached foot pedals to move in a combined revolving and axis translating manner. A flywheel or electric motor may be rotatably connected to the cranks to synchronize the cranks, and provide momentum characteristics. When used on an exercise machine, work may be performed to cause the pedals to rotate, or to cause the crank axis to translate.

20 Claims, 6 Drawing Sheets

ACTIVE CRANK AXIS CYCLE MECHANISM

BACKGROUND OF THE INVENTION

The prior art is replete with cycle mechanisms, most commonly including those used to propel bicycles and those used for stationary exercise cycle machines. All of these mechanisms receive force from feet of the operator while rotating foot pedals attached to cranks. Typically, these crank radii are approximately six inches long and share a common rotational axis secured to the machine frame as to cause the feet of the operator to travel along constant circular paths. The diameter and center of the circular foot path is usually established such that limited unbending of the operators legs occurs.

If a larger circular path diameter is established in order to increase the range of leg bending and unbending, inefficiencies result because of the increased distance the feet must travel along the path apex and path bottom. If a one way flywheel clutch is not present, then a larger flywheel may be installed to partially compensate for these inefficiencies. However, in the presence of a one way clutch, despite the additional momentum of a larger flywheel, the crank and pedals may lack sufficient inertia and mass to continue rotation at nonproductive portions of the foot path.

The nonproductive portions in which the feet impart little or no torque to the flywheel occurs at approximately the upper and lower twenty degrees of arcuate foot travel. Also, on foot pedals upon which the operators feet are not strapped or socketed, the operator can only practically apply torque to the flywheel while the operators legs are being extended.

BRIEF DESCRIPTION OF THE INVENTION

Briefly, this invention consists of a number of elements which cooperate together in a manner which yields a cycling type of motion which interfaces with the operator in a unique and novel manner. The primary application of this mechanism would be upon stationary exercise machines, although it would function, albeit somewhat inefficiently, upon road bicycles. If this design is incorporated upon road bicycles, they would more appropriately be referred to a road exercise bicycles.

The mechanism provides a means to allow foot pedals to travel along elliptical paths, the shape of which may be altered by adjustable components at the operator's discretion. The shape of the elliptical foot path may also be altered due to changes in the rate at which the operator rotates or pedals the cranks during an exercise workout. The inventor, having cycled the world around, considers such variable and non-circular foot paths as interesting, physically rewarding, and an efficient and logical means to interface with a muscle conditioning mechanism.

The elements, and the mutual arrangement and manner in which they cooperate to accomplish this are now listed and briefly described.

To begin, a right and left foot pedal, or first and second foot pedal, is each rotatably secured to respective distal ends of a first and second crank. The first and second cranks are not rigidly connected as found on common bicycle machines. In this invention, the first and second cranks are rotatably secured to a respective first and second crank axis support member. In the preferred embodiments (first and third embodiments), the right and left crank axis support members are rotatably or pivotally attached to the machine frame.

Continuing to discuss now the first embodiment, a flywheel is rotatably secured to the machine frame. This flywheel has two synchronous drive members fixed to it which share a rotational axis coaxial with the rotational axis of the flywheel. Also, each of the cranks has one drive member fixedly attached thereon, and coaxially share a rotational axis with the rotational axis of the respective first and second crank. The ratio of diameters between the right and left crank drive members to the flywheel synchronous drive members is typically established to be at least three to one (3:1).

The flywheel synchronous drive members each engage with an endless drive member such as a roller chain or timing belt. These endless drive members, or first and second endless drive members, maintain opposite diametrical orientations of the cranks while transmitting momentum and resistance characteristics of the flywheel.

The crank axis support members are independently sprung such that as the operator applies downward force to cause the effected or first crank to rotate, the force is simultaneously exerted upon the first crank axis thereby also causing the first crank axis to translate down about the first crank axis support member rotational axis. The combined motion of the first crank rotating while its crank axis is downwardly translating results in the attached crank pedal to scribe a path resembling a portion of a first ellipse. The opposite crank, or second crank, experiencing coupled rotation via synchronization through the flywheel synchronous drive members, subjects its attached foot pedal to a diametrically opposite portion of a second ellipse lying in a plane parallel to the first ellipse, as the second crank axis support member pivots and returns upward.

Other elements which may be present in the first embodiment may include dampers to act upon the crank axis support members, and a band brake or other means, to provide frictional resistance to the rotating flywheel. If a band brake is installed to act upon the flywheel, it would preferably be adjustable by the machine operator. It may be added that although this mechanism is not illustrated with means to exercise the upper body, such may be easily accomplished by installing hand cranks coupled to the flywheel, or lever arms mechanically linked to the flywheel.

Briefly describing now the second embodiment, rotational and translational cranks are again employed, but the cranks are not synchronized, and a flywheel is not present. The crank axis support members are of course sprung, yet the rotational axes of the cranks translate linearly. This linear translation of the crank axes enables a more perfect ellipse to result, although with the drawn centerline distance of approximately twenty eight inches (28") between the crank rotational axes and the flywheel rotational axis of the first embodiment, the deviation from a perfectly formed ellipse is minimal.

Briefly describing the third embodiment of the invention, a powered exercise mechanism is shown. Here the foot pedals are actually powered, or at least aided to rotate, by an electric motor. The operator in this embodiment would perform work by alternatingly pushing the first and second crank axis support member to cause them to pivot down, and subsequently allow them to alternatingly return up. The work is therefore performed against the attached compression springs and/or dampers.

In describing the foot motions that the operator will experience with this mechanism, particularly with the first embodiment, the startup period during which the flywheel is being accelerated will now be described.

First, the operator is seated, with feet placed on right and left foot pedals. Let us say that the crank radii are established at four inches (4"), and that the right crank is oriented just beyond top dead center (10 degrees into the cycle), and that the left crank is oriented just beyond bottom dead center (190 degrees into the cycle). The cranks are synchronized as to always be oriented diametrically opposite, and may have a one way clutch incorporated at the flywheel in order to allow the cranks to freewheel backward to this starting position if necessary.

Let us continue to say that the steady state rotational range of the crank axis support member is fifteen degrees (15 d), with a crank axis steady state translational range of seven inches (7"). These dimensions will allow the foot pedals to travel along an ellipse of eight inches minor axis, and fifteen inches major axis (8" by 15") during steady state operation. Let us further establish the crank axis support spring to exert a force of forty pounds (40 lbs) against the crank axis support member during steady state operation when said member is fully depressed (7" crank axis translation @ 15 d support member rotation @ pedal bottom dead center where spring constant =5.71 lb/in). The spring constant may be established to increase logarithmically beyond that position. For example let us assume that beyond the fifteen degree (15 d) depressed steady state position of the crank axis support member, the crank axis resists translating down by a value of fifty pounds per inch (k=50 lb/in). For simplicity, in this discussion we have assumed that the compression spring is always vertical, and pointed or vectored directly toward the foot pedal rotational axis. Due to mounting constraints however, the effective spring constant will decrease as the pedals are moving down, and increase when the pedals are moving up with the arrangement shown in the first figure. This is due to a changing torque arm length applied to the crank axis support member as the cranks rotate. This arrangement could be reversed if desired by locating the crank axis support member rotational axis at a position forward of the operator. Also, those skilled in the art will recognize that the spring is actually shown installed at the approximate center of the crank axis support member, which would essentially double the spring constant requirement.

Continuing now, when starting the mechanism, the operator first attempts to push a right foot down to the working stroke (assume 15") of the operator's right leg, but because the crank has not rotated appreciably, forty pounds of leg force is experienced when the crank axis has translated seven inches (7"), and the right foot has translated seven inches (7"). If the operator continues to push the right pedal down one additional inch (right foot @8", crank axis @8"), then the operator must push with a force of ninety pounds (40+50=90 lbs ). The operator cannot push the total steady state distance of fifteen inches (15"=major axis of the steady state elliptical path) at this instant because the compression spring will not allow it. A total force of four hundred and forty pounds would be required to push the right pedal down fifteen inches (15") upon this initial startup (40 lbs +8" TIMES 50 lb/inch =440 lbs).

While the operator is maintaining his/her foot at eight inches (8"), the cranks begin to rotate, causing the flywheel to begin to rotate and accelerate. The flywheel motion results in a reduction of force experienced at the right pedal, thereby allowing the operator to reduce exerted foot force while the foot is maintained at this same eight inch (8") depressed condition. If, for example, the feet are maintained at eight inches (8"), and the crank axis has translated down seven inches, at this instant the effected crank would have rotated one hundred and four degrees (104 d) from top dead center while forty pounds are exerted (7"+1"=8"=7"+4"sinA, where 1"=4"sinA, and A+90 d=orientation).

It may be noted that in place of the nonlinear spring in the above example, a linear spring may be employed in conjunction with a bumper attached to the machine frame to limit the downward range to which the crank axis support member is allowed to pivot. In, this case such a bumper limits the range to fifteen degrees (15 d).

Continuing now, between startup and steady state operation, the motion cycles change with different force and foot path parameters while the flywheel continues to accelerate. Upon steady state operation, the design right foot pedal force of forty pounds (40 lbs) would be experienced of course by the operator when the right crank has rotated to the 180 degree bottom dead center orientation, while the left crank has been rotated to top dead center. The flywheel of course is rotating at constant velocity without acceleration during steady state operation.

It may be noted that during startup, if the operator simply wishes to limit the exerted force to forty pounds (40 lbs), the flywheel will accelerate, but at a lesser rate. By applying ninety pounds (90 lbs) as in the above example, the crank is oriented to a more advantageous position to transmit torque to the flywheel due to the resulting additional rotation of the crank axis support member. For example, if the crank axis support member has pivoted 10 degrees (10 d), the attached crank has reoriented by same amount. This mechanical advantage may be effectively increased by reducing the centerline distance between the flywheel rotational axis and the respective crank rotational axes.

In continuing the discussion of the startup and steady state dynamics, a linear damper of relatively low rate may be incorporated in parallel with the crank axis support member compression spring. This damper is considered optional, with one function being to limit the upward response of the crank axis support member and reduce potential spring bounce. This damper could be made adjustable by a valve on a handle bar such that the operator could instantaneously change the dampening characteristics.

In providing additional functionality to the mechanism when used as an exercise machine, if the damper is made adjustable and is consequently adjusted to a higher rate, the work performed by the cycle mechanism would be increased appreciably thus allowing users both large and small to experience demanding exercise. The damper may be either a linear style as shown in the figures, or alternatively may be of a rotational style secured between the crank axis support member and the machine frame at the crank axis support member rotational axis.

If a design cycle crank speed of sixty cycles per minute is established, the damper will allow the crank axis support member to pivot this distance in approximately 1/120th of a second.

BRIEF DESCRIPTION OF THE DRAWINGS

The invention will be further described in conjunction with the accompanying drawings, which illustrate preferred embodiments, and wherein.

DETAILED DESCRIPTION OF THE INVENTION

Figure 1:
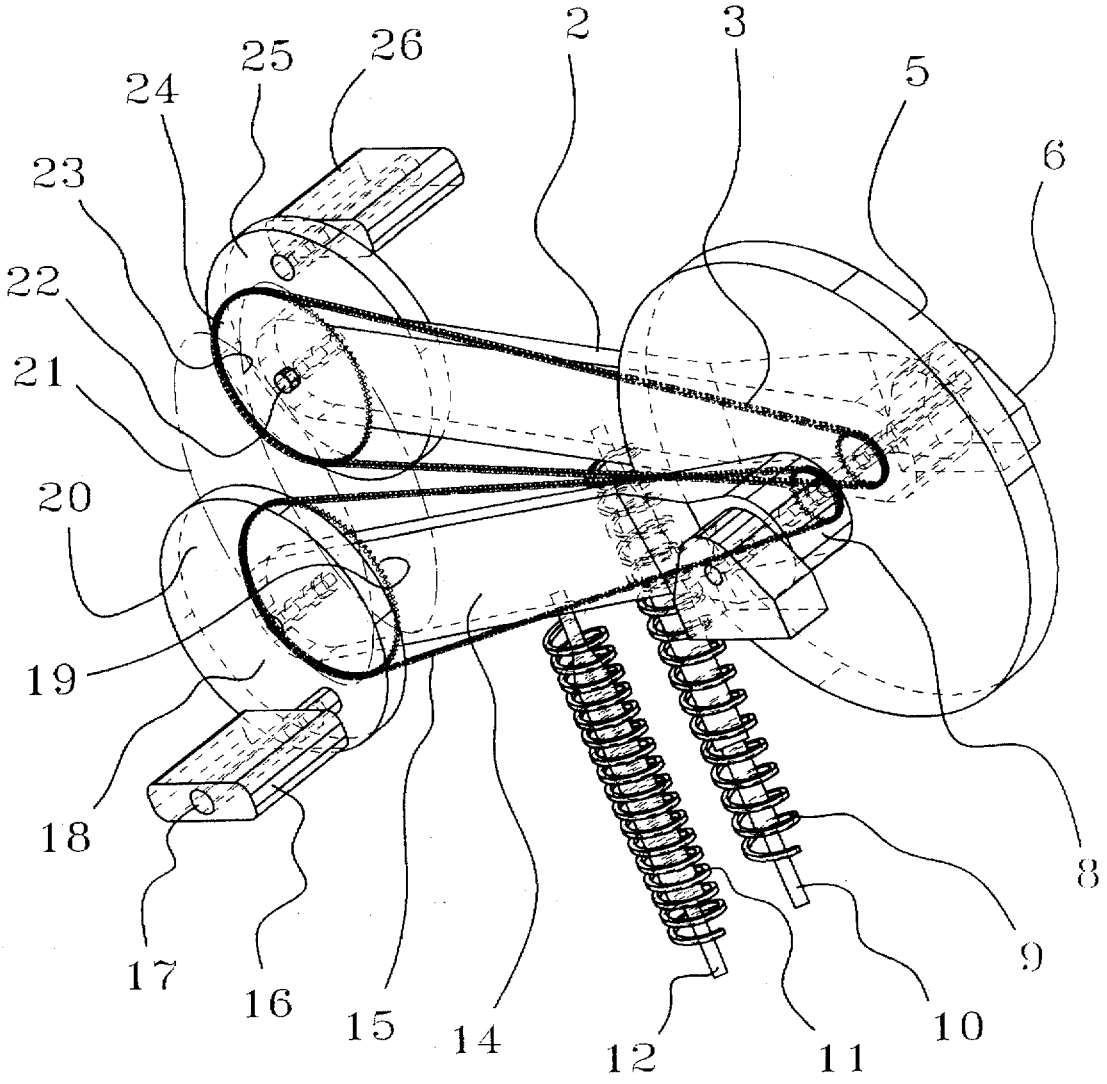
FIG. 1 is a perspective view of a first embodiment shown with one of the crank axis support members fully depressed during steady state operation.

As shown in FIG. 1, a perspective view is shown of the first embodiment. The operator will typically be seated above flywheel 5 with a right foot on first foot platform 26 and a left foot on second foot platform 16. The mechanism shall be oriented with respect to the operator such that the major axis of the elliptical foot path is aligned with the operators legs. Means may be provided to maintain the foot platforms level if a standing exercise machine, without rotatable pedals is to be constructed. Continuing now, first foot platform 26 and second foot platform 16 are each rotatably connected to a first crank 25 and a second crank 20 respectively at first and second crank radius joints. Second foot pedal axle 17 is shown visible in this perspective view. We may consider the first foot platform to be analogous to a right foot pedal and the second foot platform to be analogous to the left foot pedal. The first and second foot platform will move along the first and second elliptical path 23 and 21 respectively. Although the first crank and second crank are shown as disks, their equivalent would be a crank radius or simple crank. The disk form is shown in order to provide the user with a shield means to protect an operators legs or clothing from the adjacent crank drive member or engaging endless member. Fixed to first and second crank 25 and 20 is first and second crank drive member 24 and 19 respectively. These drive members are shown as roller chain sprockets, and engage with standard roller chain, but the mechanism will also work satisfactory with V-belt pulleys. If friction drive V-belts, flat belts, or round belts are used, the operator will be partly responsible to establish and maintain crank orientations, but this will be a natural result during use of the machine. As will be discussed shortly in the second embodiment, it is even possible to operate this machine in the absence of endless drive members. Continuing now, first and second crank shafts 22 and 18 are shown rotatably secured to first and second crank 25 and 20 respectively.

In this perspective view, first crank axis support member 2 is shown raised at rest without force or torque applied to first foot pedal 26. Second crank axis support member 14 is shown in a depressed condition where second crank 18 is oriented at one hundred and eighty degrees (180 d). The pair of flywheel synchronous drive members, shown as dashed lines in this figure, are connected to first and second crank drive members 24 and 19 respectively via first and second endless member 3 and 15. In this figure, the endless drive members consist of a roller chain.

Continuing with FIG. 1, flywheel 5 is rotatably supported at the machine by a pair of flywheel support bearings 6. To prevent possible transverse displacement or interference at first and second crank drive member 24 and 19, the crank axis support members have been enlarged at crank axis support member reinforcement 8.

During cyclic action, first compression spring 9 and second compression spring 11 will alternatingly be compressed and allowed to extend as to always independently bias the crank axis support members upward. Different spring equivalents such as air springs may also be employed to provide a means to bias the first crank axis support member upward about the first crank axis support member rotational axis. First and second linear damper 10 and 12 are installed in parallel with the compression springs, and may be adjustable to provide for different degrees of dampening resistance.

Figure 2:
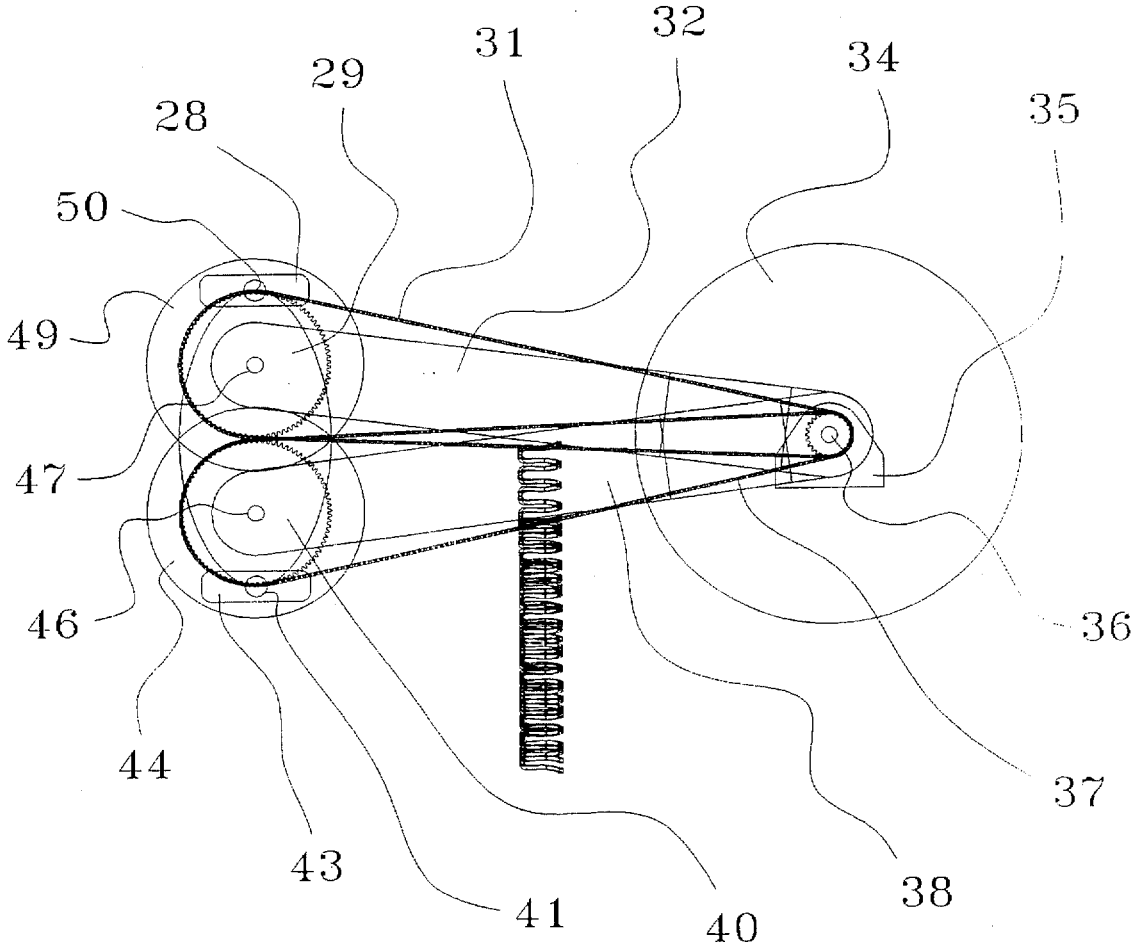
FIG. 2 is a side view of the first embodiment.

Directing attention now to FIG. 2, a side view is shown of the first embodiment. First crank pedal 28 is rotatably secured to first crank 49 at first crank radius joint 50. Second crank pedal 43 is rotatably secured to second crank 44 at second crank radius joint 41. First crank axis support member crank joint 47 rotatably secures first crank 49, and second crank axis support member crank joint 46 rotatably secures second crank 44. First crank axis support member 32 and second crank axis support member 38 are rotatably secured about flywheel axle 36, and pivot up and down during cyclic operation of the mechanism. First crank drive member 29 and second crank drive member 40 are synchronously connected, by first and second endless members 31 and 37, to a pair of synchronous drive members which are fixed to the flywheel and coaxially share a common axis of rotation. Flywheel 34 is rotatably secured to the machine frame at flywheel bearings 35. The compression springs are illustrated as each acting approximately on center between the flywheel axle and the crank axle of the respective crank axis support member. Also, in all of the illustrated embodiments, an independent spring is shown acting on each of the crank axis support members, although certain advantages would be achieved by utilizing only one spring, and connecting that spring to a yoke joining each of the crank axis support members. The advantage in a single spring arrangement is that the effective force acting against a depressed crank axis support member is increased as the opposite crank axis support member starts to move down, thus effecting a more natural cyclic rhythm. Such a yoke may be used with a mechanical spring, or with a constant force pressure actuated rod end cylinder such as would be supplied with air or hydraulic pressure.

Figure 3:
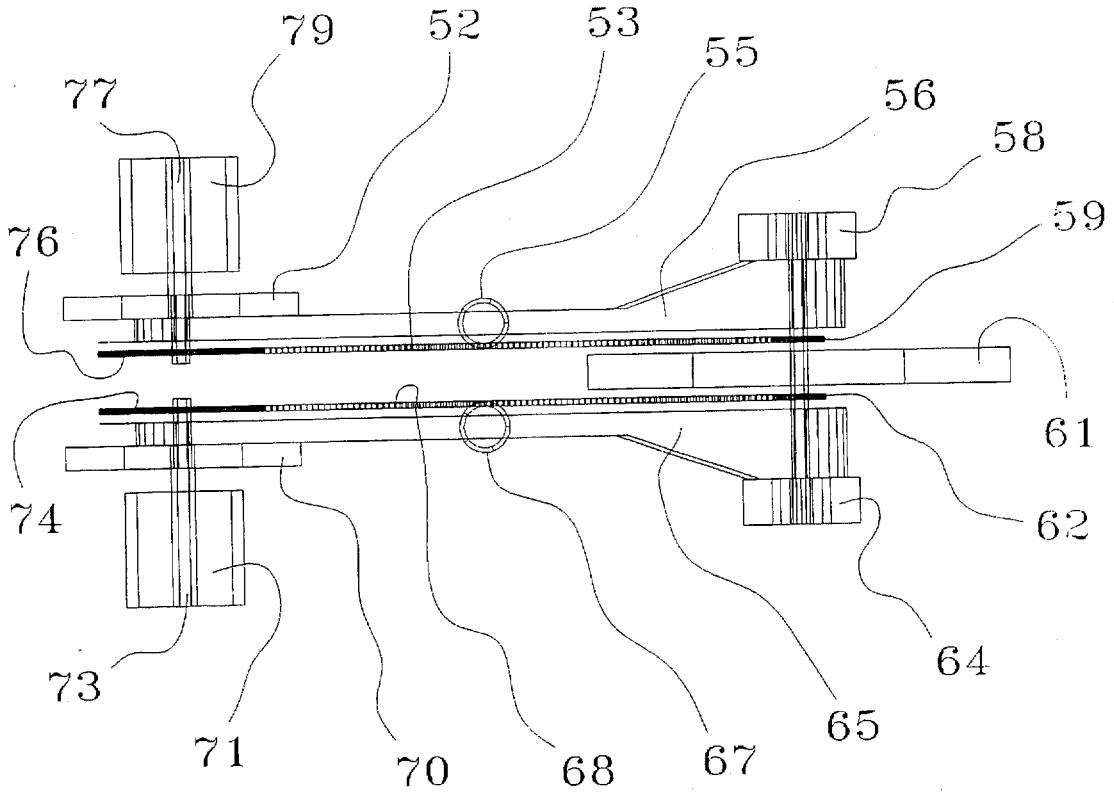
FIG. 3 is a top view of the first embodiment.

Referring now to FIG. 3, a top view is shown of the mechanism of the first embodiment where first foot platform 79 is rotatably secured to first crank 52 at first crank joint 77. Second foot platform 71 is rotatably secured to second crank 70 at second crank joint 73. First crank drive member 76 is nonrotatably secured to first crank 52 and has a rotational axis coaxial with first crank rotational axis. Second crank drive member 74 is nonrotatably secured to second crank 70 and has a rotational axis coaxial with second crank rotational axis. First crank joint 77 is coaxial with first crank axis support member crank joint of first crank axis support member 56. Second crank joint 73 is coaxial with second crank axis support member crank joint of second crank axis support member 65.

First synchronization drive member 59 and second synchronization drive member 62 have rotational axes coaxial with the rotational axis of flywheel 61. A shaft rotatably secured by first crank axis support member bearing 58 and second crank axis support member bearing 64 has an axis coaxial with the rotational axis of the flywheel and the rotational axes of the synchronization drive members. First endless member 53 and second endless member 68 synchronously connect first and second crank drive member 76 and 74 respectively to first synchronization drive member 59 and second synchronization drive member 62. It may be noted that a flywheel may be omitted from the mechanism, or that a first and second flywheel may be connected to the first and second crank respectively in place of one flywheel connected to both cranks.

In order to always independently bias the crank axis support members upward toward the operator, a first compression spring 55 and a second compression spring 67 are shown to act against the crank axis support members at a central region between the respective rotational axis of the crank axis support member and the respective crank axis support members crank joint. These compression springs may have linear or nonlinear spring constants, or may have constant force springs as in the case with air or hydraulic cylinders.

Figure 4:
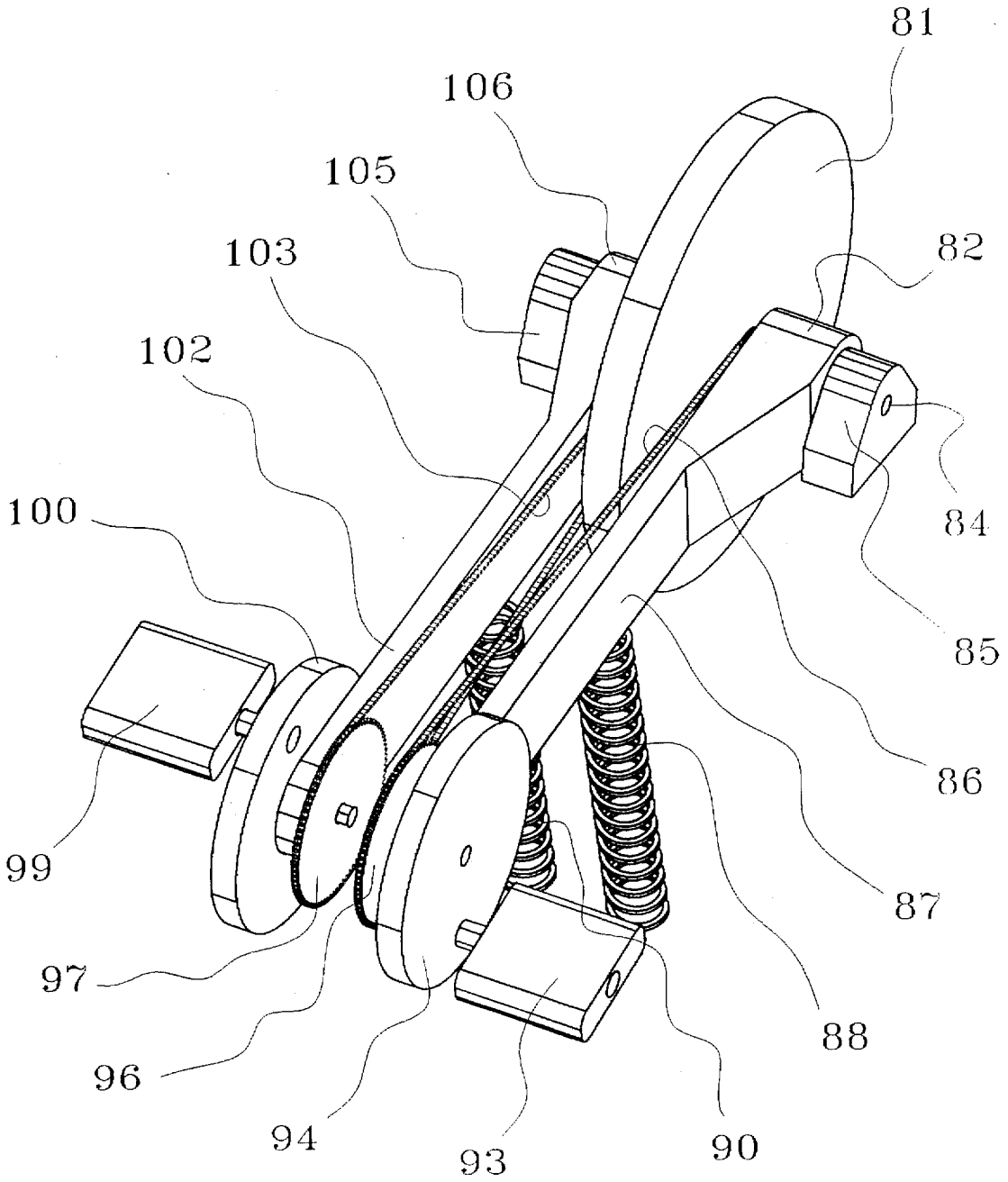
FIG. 4 is a perspective view of the first embodiment shown with the crank axis support members at rest or at the parked position.

Directing attention now to FIG. 4, another perspective view is shown of the first embodiment, and illustrates the first and second crank axis support member 102 and 87 respectively at rest in their biased upward position. First foot pedal 99 is rotatably secured to first crank 100 where first crank 100 is oriented at top dead center. Second foot pedal 93 is rotatably secured to second crank 94 where second crank is oriented at bottom dead center. First crank drive member 97 is nonrotatably secured to first crank 100 and shares a common axis of rotation. Second crank drive member 96 is nonrotatably secured to second crank 94 and also mutually shares a common axis of rotation. Flywheel 81 is rotatably secured between first and second crank axis support member reinforcement 106 and 82 respectively. Flywheel axle 84 is rotatably secured at first flywheel bearing 105 and second flywheel bearing 85. First and second endless member 103 and 86 rotatably connects the first and second crank drive members 97 and 96 respectively with a pair synchronous drive members juxtaposed to each side of the flywheel, and unillustrated in this figure. First and second compression springs 90 and 88 are at rest, and at equal length.

Figure 5:
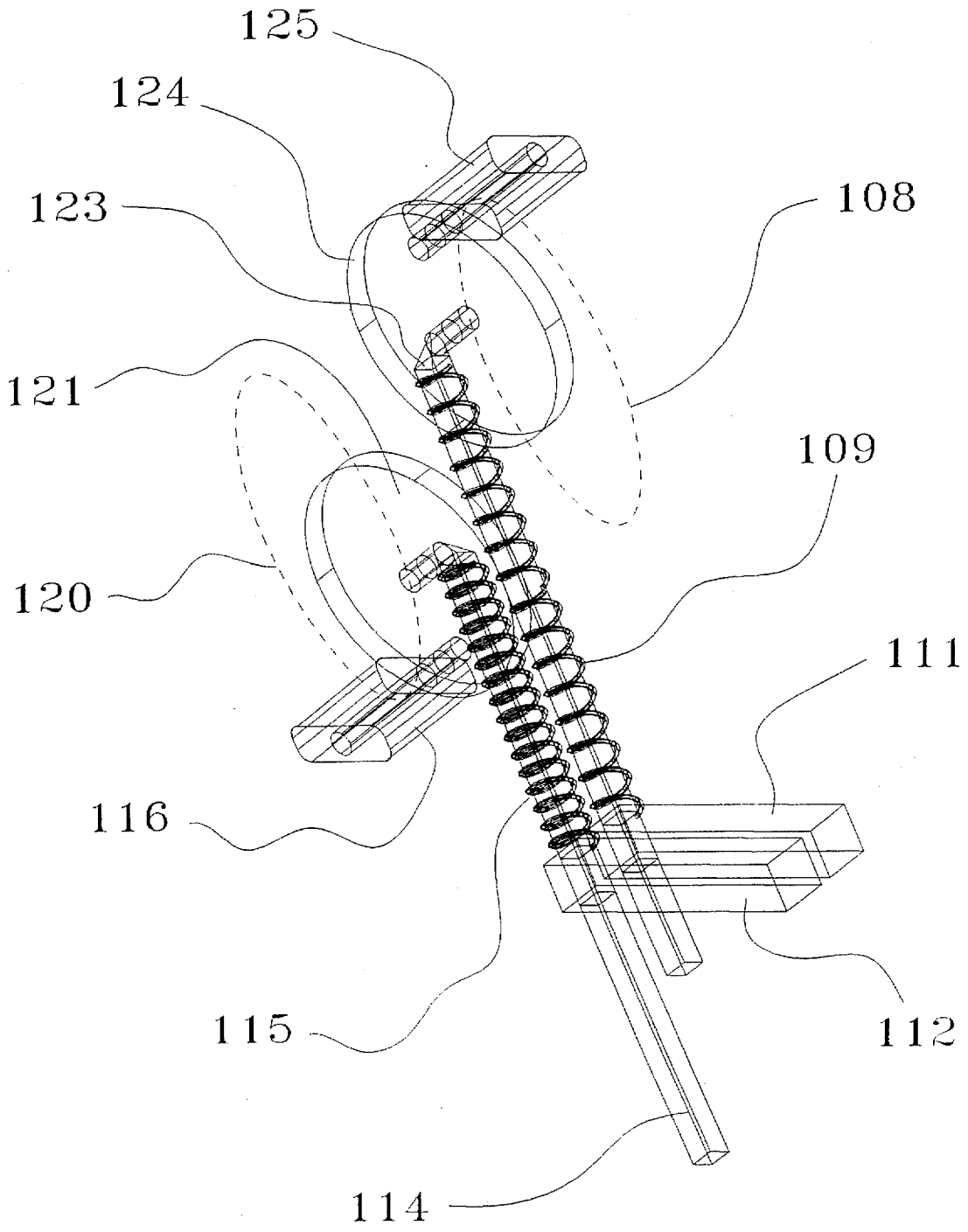
FIG. 5 is a perspective view of a second embodiment.

Referring now to FIG. 5, the second embodiment is shown which operates without synchronizing members, and without a flywheel. First foot platform 125 is rotatably secured to first crank 124, and first crank axis support 123 is shown slidably secured to machine frame 111. Second foot platform 116 is rotatably secured to second crank 121, and second crank axis support 114 is shown slidably secured to machine frame 112. First compression spring 109 is shown extended and relaxed, while second compression spring 115 is shown compressed and in a stressed state. This embodiment is preferably installed in a exercise machine upon which the operator is seated. Momentum characteristics may be increased by increasing the inertia and mass properties of the first and second crank.

Figure 6:
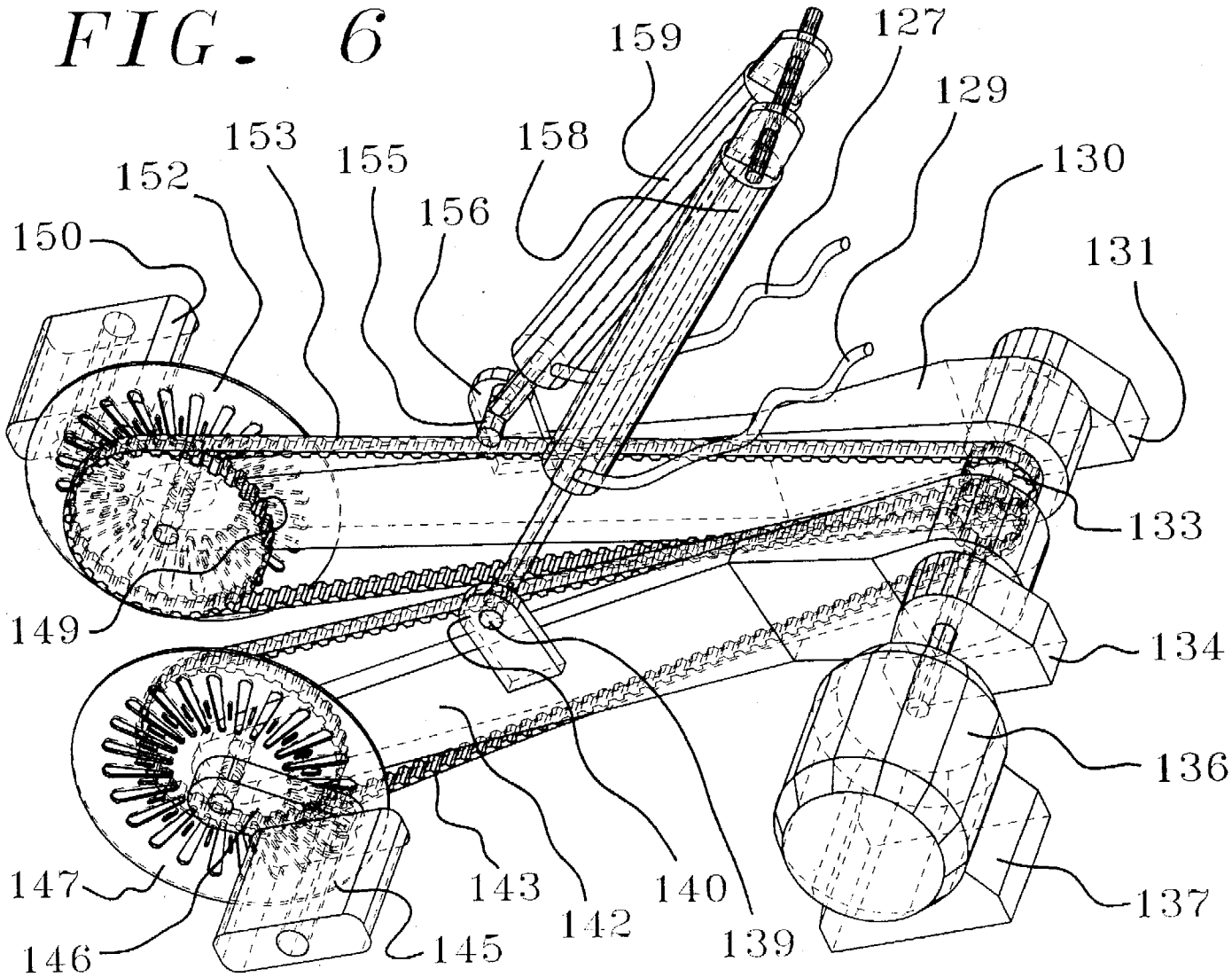
FIG. 6 is a perspective view of a third embodiment.

Referring finally to FIG. 6, the third embodiment is shown which provides for a powered exercise device new in the art. First foot platform 150 is rotatably secured to first crank oriented at forty five degrees (45 d) into the cycle. First crank is rotatably secured to a first crank axis support member 130 and is shown biased upward. Second foot platform 145 is rotatably secured to second crank 146, where second crank 146 is oriented at two hundred and twenty five degrees (225 d) into the cycle. Second crank 146 is rotatably secured to a second crank axis support member 142 and is shown biased downward. First crank drive member 149 is fixedly secured coaxially with first crank, and is rotatably connected to first synchronous drive member 133 by first endless member 153. Second crank drive member is fixedly secured coaxially with second crank 146, and is rotatably connected to second synchronous drive member by second endless member 143. In this figure, the crank drive members and the synchronous drive members illustrate timing belt sprockets. These timing belt sprockets engage with endless members drawn also in this figure, and more accurately identified as timing belts. Timing belts do not rely upon friction to transmit torque, but rather transmit torque via laterally oriented belt teeth spaced apart along the belts inner circumference.

First crank (not numbered) and second crank 146 are represented as a more typical bicycle pedal cranks because first and second leg shields 152 and 147 respectively are included with the mechanism to protect the operator from potential clothing snags or injury between crank sprocket and engaging endless member juxtaposed to the foot pedal.

Electric motor 136 drives a synchronous shaft supported by first and second synchronous shaft bearings 131 and 134 respectively, and may optionally be installed with an overrunning freewheel clutch, or slip clutch as desired. In the latter case, the motor may be a low torque motor only capable of assisting during crank rotation. Continuing, synchronous drive members are nonrotatably and coaxially secured to synchronous shaft, and first and second crank axis support members 130 and 142 are rotatably secured to synchronous shaft. Electric motor is stationary to machine frame at electric motor mount 137. It may be noted that if desired, the electric motor may be adapted to function as an electronic or simulated flywheel.

The user of this machine will perform work primarily by alternatingly pushing the crank axis support members down, and allowing them to return to their biased upward position. First and second air springs 159 and 158 respectively may be supplied by constant air (or hydraulic) pressure at first and second hose 127 and 129 respectively. These pressure actuated rod end cylinders (air springs) exert constant force at first and second cylinder rod end 155 and 139 rotatably secured to first and second crank axis support member rod mounts 156 and 140 respectively. Mechanical springs may of course be substituted for these pressure actuated rod end cylinders if the exerted force is desired to be some function of the displaced distance.

Linear dampers (dampening in one or two directions), or rotational dampers may be employed as desired to add motion resistance to the crank axis support members. Also, a wide range of linear or rotary actuators, servo motors, electric clutches, and other mechanical/electro, or programmable hardware may be incorporated upon the mechanism to improve the physical interface between the operator and the machine should such enhancements be sought. Such enhancements could also entail establishing spring constants and/or damper values which are a function of flywheel rotational speed, where upon startup the spring constant and/or damper value is very high, and upon steady state operation the spring constant and/or damper value has been minimized.

Thus, an improved cycling mechanism is shown which provides the operator with motion and force characteristics new in the art. While preferred embodiments of the invention have been shown and described, it will be apparent to those skilled in the art that changes and modifications can be made in these embodiments without departing from the principles and spirit of the invention, the scope of which is defined in the appended claims.

I claim:

1. An exercise apparatus, comprising:

a frame;

a first arm pivotally connected to the frame and pivotal about a first pivot axis;

a first crank rotatably connected to the first arm and rotatable about a first crank axis which is radially displaced from the first pivot axis;

a first user foot support force receiving member connected to the first crank and rotatable about the first crank axis;

a second arm pivotally connected to the frame and pivotal about a second pivot axis;

a second crank rotatably connected to the second arm and rotatable about a second crank axis which is radially displaced from the second pivot axis; and a second user foot support force receiving member connected to the second crank and rotatable about the second crank axis.

2. The exercise apparatus of claim 1, further comprising a means, interconnected between the first crank and the second crank, for synchronizing rotation of the first crank and the second crank.

3. The exercise apparatus of claim 2, wherein the first pivot axis and the second pivot axis are coaxial, and the means includes:

a third crank rotatably connected to the frame and rotatable about the first pivot axis;

a first flexible loop interconnected between the first crank and the third crank; and a second flexible loop interconnected between the second crank and the third crank.

4. The exercise apparatus of claim 3, wherein the third crank includes a flywheel.

5. The exercise apparatus of claim 1, further comprising a means, connected to the frame, for biasing at least one of the first arm and the second arm in a particular direction relative to the frame.

6. The exercise apparatus of claim 5, wherein the means includes at least one spring disposed between the frame and at least one of the first arm and the second arm.

7. The exercise apparatus of claim 1, further comprising a first spring disposed between the frame and the first arm; and a second spring disposed between the frame and the second arm.

8. The exercise apparatus of claim 1, wherein the first pivot axis and the second pivot axis are coaxial.

9. The exercise apparatus of claim 8, further comprising a flywheel rotatably connected to the frame and rotatable about the first pivot axis and constrained to rotate together with the first crank and the second crank.

10. The exercise apparatus of claim 1, wherein the first force receiving member is a pedal rotatably connected to the first crank and rotatable about a pedal axis which is radially displaced from the first crank axis; and the second force receiving member is a pedal rotatably connected to the second crank and rotatable about a pedal axis which is radially displaced from the second crank axis.

11. An exercise apparatus, comprising:

a frame;

a first crank having a first crank axis;

a first user foot support force receiving member connected to the first crank and rotatable about the first crank axis;

a first means, connected to the frame, for connecting the first crank to the frame in such a manner that the first crank axis is movable relative to the frame;

a second crank having a second crank axis;

a second user foot support force receiving member connected to the second crank and rotatable about the second crank axis;

a second means, connected to the frame, for connecting the second crank to the frame in such a manner that the second crank axis is movable relative to the frame;

a third means, connected to the frame, for biasing the first crank axis toward a first position relative to the frame; and a fourth means, connected to the frame, for biasing the second crank axis toward a second position relative to the frame.

12. The exercise apparatus of claim 11, wherein the first means includes a first arm pivotally connected to the frame, and the first crank is rotatably connected to the first arm; and the second means includes a second arm pivotally connected to the frame, and the second crank is rotatably connected to the second arm.

13. The exercise apparatus of claim 12, wherein the third means includes a first spring disposed between the frame and the first arm; and the fourth means includes a second spring disposed between the frame and the second arm.

14. The exercise apparatus of claim 11, wherein the first means includes a first arm slidably connected to the frame, and the first crank is rotatably connected to the first arm; and the second means includes a second arm slidably connected to the frame, and the second crank is rotatably connected to the second arm.

15. The exercise apparatus of claim 14, wherein the third means includes a first spring disposed between the frame and the first crank axis; and the fourth means includes a second spring disposed between the frame and the second crank axis.

16. The exercise apparatus of claim 11, wherein the first force receiving member is a pedal rotatably connected to the first crank and rotatable about a pedal axis which is radially displaced from the first crank axis; and the second force receiving member is a pedal rotatably connected to the second crank and rotatable about a pedal axis which is radially displaced from the second crank axis.

17. The exercise apparatus of claim 11, further comprising a fifth means, interconnected between the first crank and the second crank, for synchronizing rotation of the first crank and the second crank.

18. The exercise apparatus of claim 17, wherein the fifth means includes a shaft rotatably connected to the frame; a first flexible loop interconnected between the shaft and the first crank; and a second flexible loop interconnected between the shaft and the second crank.

19. An exercise apparatus, comprising:

a frame;

a first arm pivotally connected to the frame and pivotal about a first pivot axis;

a first spring disposed between the first arm and a first portion of the frame and biasing the first arm from the first portion of the frame;

a first crank rotatably connected to the first arm and rotatable about a first crank axis which is radially displaced from the first pivot axis;

a first user foot support force receiving member connected to the first crank and rotatable about the first crank axis;

a second arm pivotally connected to the frame and pivotal about a second pivot axis;

a second spring disposed between the second arm and a second portion of the frame and biasing the second arm from the second portion of the frame;

a second crank rotatably connected to the second arm and rotatable about a second crank axis which is radially displaced from the second pivot axis;

a second user foot support force receiving member connected to the second crank and rotatable about the second crank axis; and a third crank rotatably connected to the frame and rotatable about the first pivot axis, wherein the third crank and the first crank are linked to rotate together, and the third crank and the second crank are linked to rotate together.

20. The exercise apparatus of claim 19, further comprising a flywheel rotatably connected to the frame and linked to rotate together with the third shaft.

* * * * *